US005744297A

United States Patent [19]

Chang et al.

[11] Patent Number: 5,744,297

[45] Date of Patent: *Apr. 28, 1998

[54] HIGH CHLORIDE (100) TABULAR GRAIN EMULSIONS CONTAINING LARGE, THIN TABULAR GRAINS

[75] Inventors: Yun C. Chang; Rajesh V. Mehta; Lois A. Buitano, all of Rochester, N.Y.

[73] Assignee: Eastman Kodak Company, Rochester, N.Y.

[ * ] Notice: The term of this patent shall not extend beyond the expiration date of Pat. No. 5,663,041.

[21] Appl. No.: 814,209

[22] Filed: Mar. 11, 1997

Related U.S. Application Data

[62] Division of Ser. No. 603,792, Feb. 20, 1996, Pat. No. 5,663,041.

[51] Int. Cl.[6] ..... G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 5,238,805 | 8/1993 | Saitou | 430/569 |
| 5,254,454 | 10/1993 | Mimiya et al. | 430/569 |
| 5,292,632 | 3/1994 | Maskasky | 430/567 |
| 5,314,798 | 5/1994 | Brust et al. | 430/567 |
| 5,320,938 | 6/1994 | House et al. | 430/567 |
| 5,413,904 | 5/1995 | Chang et al. | 430/567 |
| 5,607,828 | 3/1997 | Maskasky | 430/567 |
| 5,663,041 | 9/1997 | Chang et al. | 430/569 |

*Primary Examiner*—Mark F. Huff
*Attorney, Agent, or Firm*—Carl O. Thomas

[57] ABSTRACT

A radiation-sensitive emulsion is disclosed in which at least 70 percent of total grain projected area is accounted for by tabular grains (a) having {100} major faces, (b) containing greater than 50 mole percent chloride, based on silver, (c) having a mean equivalent circular diameter in the range of from 2.0 to 5.0 μm, and (d) exhibiting a mean thickness of 0.1 μm or less.

The emulsion is prepared by (a) precipitating up to 10 percent of the total silver forming the high chloride {100} tabular grains to create a first grain population under conditions that form a crystal lattice structure that favors the growth of high chloride {100} tabular grains, (b) thereafter rapidly introducing silver and halide ions to create a second grain population, and (c) growing the first grain population to create the high chloride {100} tabular grains by ripening out the second grain population.

7 Claims, No Drawings

HIGH CHLORIDE (100) TABULAR GRAIN EMULSIONS CONTAINING LARGE, THIN TABULAR GRAINS

CROSS-REFERENCE TO RELATED APPLICATIONS

This is a divisional of application Ser. No. 08/603,792, filed Feb. 20, 1996, now U.S. Pat. No. 5,663,041.

FIELD OF THE INVENTION

The invention relates to silver halide photography. More specifically, the invention relates to an improvement in photographically useful radiation-sensitive high chloride {100} tabular grain emulsions.

DEFINITION OF TERMS

In referring to silver halide grains or emulsions containing two or more halides, the halides are named in order of ascending concentrations.

The term "high chloride" in referring to silver halide grains and emulsions is employed to indicate greater than 50 mole percent chloride, based on total silver forming the grains and emulsions, respectively.

The term "equivalent circular diameter" (ECD) of a grain is the diameter of a circle having an area equal to the projected area of the grain.

The term "aspect ratio" of a silver halide is the ratio of its ECD divided by its thickness (t).

The term "tabular grain" is defined as a grain having an aspect ratio of at least 2.

The term "tabular grain emulsion" is defined as an emulsion in which at least 50 percent of total grain projected area is accounted for by tabular grains.

The term "very thin" in referring to tabular grains and tabular grain emulsions refers to mean tabular grain thicknesses of 0.1 μm or less.

The terms "{100} tabular" and "{111} tabular" in referring to tabular grains and emulsions are employed to indicate that the tabular grains have major faces that lie in {100} and {111} crystal lattice planes, respectively.

*Research Disclosure* is published by Kenneth Mason Publications, Ltd., Dudley House, 12 North St., Emsworth, Hampshire P010 7DQ, England.

BACKGROUND

Maskasky U.S. Pat. No. 5,292,632 reported the discovery of high chloride {100} tabular grain emulsions. Maskasky reports no emulsion preparations in which the high chloride {100} tabular grains have a thickness of 0.1 μm or less. The thinnest tabular grain emulsion set out in the Maskasky examples has a thickness already increased to 0.115 μm at a mean grain ECD of only 1.28 μm. In the only two examples provided by Maskasky that show mean ECD's of 2.0 μm or more, the emulsion with a mean tabular grain ECD of 2.18 μm exhibits a mean thickness of 0.199 μm while the emulsion with a mean ECD of 2.20 μm exhibits a mean thickness of 0.23 μm. The high chloride {100} tabular grains of Maskasky were obtained by adsorbing a grain growth modifier to the surfaces of the grains.

House et al U.S. Pat. No. 5,320,938, relying on iodide introduced during grain nucleation to promote high chloride {100} tabular grain growth, discloses as its thinnest tabular grain example an emulsion having in a selected grain population a mean grain thickness of 0.033 μm, but with an ECD of only 0.54 μm. In the only two examples provided by House et al that show mean ECD's of 2.0 μm or more, the emulsion with a mean tabular grain ECD of 2.28 μm exhibits a mean thickness of 0.195 μm while the emulsion with a mean ECD of 2.55 μm exhibits a mean thickness of 0.165 μm.

Brust et al U.S. Pat. No. 5,314,798, an improvement on House et al that adds a higher iodide band to improve emulsion sensitivity, provides no example of a high chloride {100} tabular grain emulsion having a mean grain thickness of 0.1 μm or less. The largest mean ECD high chloride {100} tabular grain emulsion included in the Brust et al examples exhibits a mean ECD of 2.1 μm and a mean thickness of 0.16 μm.

Chang et al U.S. Pat. No. 5,413,904 discloses an improvement on the precipitation process of House et al wherein iodide introduction is delayed until after grain nucleation as a technique for increasing the percentage of total grain projected area accounted for by high chloride {100} tabular grains. Chang et al reports a tabular grain emulsion having a mean ECD of only 1.04 Mm having very thin (0.07 μm) grains; however, the thicknesses of the example emulsions having a mean ECD of at least 2.0 μm ranged from 0.14 to 0.25 μm.

PROBLEM TO BE SOLVED

Prior to the present invention the art has not had in its possession high chloride {100} tabular grain emulsions with mean ECD's of 2.0 μm and higher in which the tabular grains have remained, on average, very thin. Thus, those working in the art have had no access to high chloride {100} tabular grain emulsions matching the mean ECD's and thicknesses of the highest performing {111} tabular grain emulsions in current use.

SUMMARY OF THE INVENTION

In one aspect the invention is directed to a radiation-sensitive emulsion comprised of a dispersing medium and silver halide grains wherein at least 70 percent of total grain projected area is accounted for by tabular grains (a) having {100} major faces, (b) containing greater than 50 mole percent chloride, based on silver, (c) having a mean equivalent circular diameter in the range of from 2.0 to 5.0 μm, and (d) exhibiting a mean thickness of 0.1 μm or less.

DESCRIPTION OF PREFERRED EMBODIMENTS

The present invention satisfies a heretofore unmet need in the photographic art for a very thin high chloride {100} tabular grain emulsion exhibiting a mean ECD in the range of from 2.0 to 5.0 μm, the grain size range required for the formation of the highest speed emulsions.

More specifically, this invention provides a radiation-sensitive emulsion comprised of a dispersing medium and silver halide grains wherein greater than 50 percent of total grain projected area is accounted for by tabular grains (a) having {100} major faces, (b) containing greater than 50 mole percent chloride, based on silver, (c) having a mean equivalent circular diameter in the range of from 2.0 to 5.0 μm, and (d) exhibiting a mean thickness of 0.1 μm or less.

The high chloride {100} tabular grains account for at least 70 percent of total grain projected area and preferably at least 90 percent of total grain projected area. Emulsions in which the high chloride {100} tabular grains account for greater than 95 percent of total grain projected area are specifically contemplated and can be realized with well controlled emulsion precipitations.

The high chloride {100} tabular grains contain greater than 50 mole percent chloride, based on silver. The high chloride {100} tabular grains preferably contain greater than 70 mole percent chloride and, optimally, greater than 90 mole percent chloride, based on silver. House et al, cited above, discloses that iodide levels down to 0.001 mole percent, preferably at least 0.01 mole percent, based on silver, are capable of producing high chloride {100} tabular grains. Hence, the {100} tabular grains can approach pure chloride compositions. Iodide is preferably limited to less than 10 mole percent and, most preferably, less than 5 mole percent, based on silver. In their preferred form the high chloride {100} tabular grains are silver iodochloride grains.

Bromide can, if desired, replace a portion of the chloride introduced following grain nucleation, as permitted by the chloride and iodide range limits above. It has been disclosed additionally by Saito EPO 0 584 644 A2 that bromide can be used in place of iodide to create the crystal structure modifications required to obtain high chloride {100} tabular grains. Thus, full or partial replacement of iodide with bromide is contemplated as well as replacement of a portion of the chloride with bromide.

The high chloride {100} tabular grains have a mean thickness of 0.1 μm or less and exhibit a mean ECD in the range of from 2.0 to 5.0 μn. A preferred minimum ECD is 2.5 μm. A preferred maximum mean ECD is 4.0 μm. It is believed that, with preparation process optimization, the maximum ECD can be extended to higher mean ECD's while retaining very thin tabular grains. With present preparation process capabilities high chloride {100} tabular grain mean thicknesses of down to 0.07 μm are feasible. It is, of course, recognized that, prior to and in the course of being grown to mean ECD's in the range of from 2.0 to 4.0 μm, the high chloride {100} tabular grains can exhibit mean thicknesses well below 0.07 μm.

The very thin 2.0 to 5.0 μm mean ECD high chloride {100} tabular grain emulsions of the invention have been made possible by a novel process for their preparation. Specifically, it has been discovered that the mean thickness of 2.0 to 5.0 μm mean ECD high chloride {100} tabular grains can be reduced by modifying the procedure for grain growth following grain nucleation and introduction of the crystal structure responsible for {100} tabular grains emerging during grain growth.

Grain nucleation is preferably undertaken by any of the various procedures taught by House et al, Brust et al or Chang et al, all cited above and here incorporated by reference. The procedures of House et al and Brust et al introduce silver and chloride ions by double-jet procedures while maintaining the dispersing medium (typically gelatin and water) in the reaction vessel in the pCl range of from 0.5 to 3.5 by the prior addition of a soluble chloride salt. Iodide is also present in the reaction vessel at the outset of double-jet precipitation or added with the chloride salt during double-jet addition. House et al contemplates iodide concentrations ranging from 0.001 (preferably 0.01 and optimally 0.05) mole percent up to less than 10 mole percent, based on silver present in the reaction vessel.

Chang et al observed that the percent of total grain projected area accounted for high chloride {100} tabular grains can be increased (and conversely the proportion of less useful grains can be decreased) by delaying iodide introduction until after grain nucleation. Chang et al divides iodide introduction into Step (1), iodide introduction to produce the crystal structure modifications required for high chloride {100} tabular grains to emerge during subsequent grain growth, and Step (2), the optional introduction of iodide during subsequent grain growth. The precipitation process of the invention in its preferred form follows the procedure of Chang et al through Step (1).

Following the procedure of Chang et al, at the outset of precipitation a reaction vessel is provided containing a dispersing medium and conventional silver and reference electrodes for monitoring halide ion concentrations within the dispersing medium. Halide ion is introduced into the dispersing medium that is at least 50 mole percent chloride—i.e., at least half by number of the halide ions in the dispersing medium are chloride ions. The pCl of the dispersing medium is adjusted to favor the formation of {100} grain faces on nucleation—that is, within the range of from 0.5 to 3.5, preferably within the range of from 1.0 to 3.0 and, optimally, within the range of from 1.5 to 2.5.

The grain nucleation step is initiated when a silver jet is opened to introduce silver ion into the dispersing medium. Iodide ion is withheld from the dispersing medium until after the onset of grain nucleation. Preferably iodide ion introduction is delayed until at least 0.005 percent of total silver used to form the emulsion has been introduced into the dispersing medium. Preferred results (high chloride {100} tabular grain projected areas of greater than 95 percent in the completed emulsions) are realized when iodide ion introduction is initiated in the period ranging from 0.01 to 3 (optimally 1.5) percent of total silver introduction.

Effective tabular grain formation can occur over a wide range of iodide ion concentrations ranging up to the saturation limit of iodide in silver chloride. The saturation limit of iodide in silver chloride is reported by H. Hirsch, "Photographic Emulsion Grains with Cores: Part I. Evidence for the Presence of Cores", J. of Photog. Science, Vol. 10 (1962), pp. 129–134, to be 13 mole percent. In silver halide grains in which equal molar proportions of chloride and bromide ion are present up to 27 mole percent iodide, based on silver, can be incorporated in the grains. It is contemplated to undertake grain growth below the iodide saturation limit to avoid the precipitation of a separate silver iodide phase and thereby avoid creating an additional category of less useful grains. It is generally preferred to maintain the initial iodide ion concentration after its delayed introduction into the dispersing medium at less than 10 mole percent. In fact, only minute amounts of iodide are required to achieve the desired tabular grain population. Concentrations of iodide after its delayed introduction down to 0.001 mole percent, based on total silver, are contemplated. For convenience in replication of results, it is preferred to maintain iodide ion concentrations, after delayed iodide introduction, in the range of at least 0.005 mole percent and, optimally, at least 0.07 mole percent, based on total silver. The preferred delays of iodide ion introduction noted above are effective with minimum and near minimum iodide introduction levels. To maintain tabular grain mean thickness levels in the ranges required by the invention it is contemplated to introduce iodide for crystal structure modification resulting in tabular grain growth before 10 percent of total silver has been introduced, preferably before 55 percent of total silver has been introduced.

In a preferred method silver chloride grain nuclei are formed at the outset of the nucleation step. Minor amounts of bromide ion can be present also in the dispersing medium at the outset of nucleation. Any amount of bromide ion can be present in the dispersing medium at the outset of nucleation and subsequently that is compatible with at least 50 mole percent of the halide in the grain nuclei being chloride ions. The grain nuclei preferably contain at least 70 mole percent and optimally at least 90 mole percent chloride ion, based on silver.

Grain nuclei formation occurs instantaneously upon introducing silver ion into the dispersing medium. Precipitation under the initial conditions in the reaction vessel, hereinafter referred to as Step (1) conditions, can be terminated at any time after the minimum iodide addition described above has been completed. Since silver iodide is much less soluble than silver chloride, any iodide ion introduced into the dispersing medium precipitates instantaneously. For manipulative convenience and reproducibility, silver ion introduction under Step (1) conditions is preferably extended for a convenient period, typically from 5 seconds to less than 2 minutes, and typically during this period from about 0.1 to 10 mole percent of total silver is introduced into the dispersing medium. So long as the pCl remains within the ranges set forth previously no additional chloride ion need be added to the dispersing medium during Step (1). It is, however, preferred to introduce both silver and halide salts concurrently during this step. The advantage of adding halide salts concurrently with silver salt throughout Step (1) is that the variation of pCl within the dispersing medium can be minimized or eliminated. Once sufficient iodide introduction has occurred to initiate tabular grain growth, further iodide introduction is not required to sustain tabular grain growth. Thus, subsequent iodide introduction in either or both of Step (1) or the subsequent growth step is a matter of preference only based on well known photographic performance considerations.

Any convenient conventional choice of soluble silver and halide salts can be employed during the Step (1). Silver ion is preferably introduced as an aqueous silver salt solution, such as a silver nitrate solution. Halide ion is preferably introduced as alkali or alkaline earth halide, such as lithium, sodium, potassium and/or calcium chloride, bromide and/or iodide.

The dispersing medium contained in the reaction vessel prior to nucleation is comprised of water, the dissolved halide ions discussed previously and a peptizer. The dispersing medium can exhibit a pH within any convenient conventional range for silver halide precipitation, typically from 2 to 8. It is preferred, but not required, to maintain the pH of the dispersing medium on the acid side of neutrality (i.e., <7.0). To minimize fog a preferred pH range for precipitation is from 2.0 to 6.0. Mineral acids, such as nitric acid or hydrochloride acid, and bases, such as alkali hydroxides, can be used to adjust the pH of the dispersing medium. It is also possible to incorporate pH buffers.

The peptizer can take any convenient conventional form known to be useful in the precipitation of photographic silver halide emulsions and particularly tabular grain silver halide emulsions. A summary of conventional peptizers is provided in *Research Disclosure*, Vol. 365, September 1994, Item 36544, Section II. Vehicles, vehicle extenders, vehicle-like addenda and vehicle related addenda, A. Gelatin and hydrophilic colloid peptizers. It is preferred to employ gelatino-peptizers (e.g., gelatin and gelatin derivatives). As manufactured and employed in photography gelatino-peptizers typically contain significant concentrations of calcium ion, although the use of deionized gelatino-peptizers is a known practice. In the latter instance it is preferred to compensate for calcium ion removal by adding divalent or trivalent metal ions, such alkaline earth or earth metal ions, preferably magnesium, calcium, barium or aluminum ions. Specifically preferred peptizers are low methionine gelatino peptizers (i.e., those containing less than 30 micromoles of methionine per gram of peptizer), optimally less than 12 micromoles of methionine per gram of peptizer, these peptizers and their preparation are described by Maskasky U.S. Pat. No. 4,713,323 and King et al U.S. Pat. No. 4,942,120, the disclosures of which are here incorporated by reference. However, it should be noted that the grain growth modifiers of the type known to produce {111} tabular grains (e.g., the grain growth modifiers taught by Maskasky U.S. Pat. No. 4,713,323) are not appropriate for inclusion in the dispersing media. It is possible to employ grain growth modifiers known to promote the formation of high chloride {100} tabular grain emulsions, as taught by Maskasky U.S. Pat. No. 5,292,632, although the use of a grain growth modifier is neither required nor preferred. Generally at least about 10 percent and typically from 20 to 80 percent of the dispersing medium forming the completed emulsion is present in the reaction vessel at the outset of the nucleation step. It is conventional practice to maintain relatively low levels of peptizer, typically from 10 to 20 percent of the peptizer present in the completed emulsion, in the reaction vessel at the start of precipitation. To increase the proportion of thin tabular grains having {100} faces formed during nucleation it is preferred that the concentration of the peptizer in the dispersing medium be in the range of from 0.5 to 6 percent by weight of the total weight of the dispersing medium at the outset of the nucleation step. It is conventional practice to add gelatin, gelatin derivatives and other vehicles and vehicle extenders to prepare emulsions for coating after precipitation. Any naturally occurring level of methionine can be present in gelatin and gelatin derivatives added after precipitation is complete.

Step (1) can be performed at any convenient conventional temperature for the precipitation of silver halide emulsions. Temperatures ranging from near ambient—e.g., 30° C. up to about 90° C. are contemplated, with nucleation temperatures in the range of from 35° to 70° C. being preferred.

Upon the completion of Step (1) a high chloride {100} grain population is present in the reaction vessel that contains the crystal lattice structure modifications that favor the emergence of high chloride {100} tabular grains on further growth.

It is preferred to hold the emulsion briefly following the completion of Step (1) to increase the uniformity of the grain population and, hence, to obtain a more monodisperse final emulsion. One technique for increasing grain monodispersity is to interrupt silver and halide salt introductions at the earliest convenient time after a stable population of grain nuclei have been formed. This can occur before or after iodide addition. The preferred technique is introduce iodide earlier rather than later and to delay the ripening hold until after the iodide modifications of the crystal lattice structure have been introduced. The emulsion is held within the temperature ranges described above for Step (1) for a period sufficient to allow reduction in grain dispersity. A holding period can range from a minute to several hours, with typical holding periods ranging from 5 minutes to an hour. During the holding period relatively smaller grain nuclei are Ostwald ripened onto surviving, relatively larger grain nuclei, and the overall result is a reduction in grain dispersity.

If desired, the rate of ripening can be increased by the presence of a ripening agent in the emulsion during the holding period. A conventional simple approach to accelerating ripening is to increase the halide ion concentration in the dispersing medium. This creates complexes of silver ions with plural halide ions that accelerate ripening. When this approach is employed, it is preferred to increase the chloride ion concentration in the dispersing medium. That is, it is preferred to lower the pCl of the dispersing medium into a range in which increased silver chloride solubility is observed. Alternatively, ripening can be accelerated and the percentage of total grain projected area accounted for by {100} tabular grains can be increased by employing conventional ripening agents. Preferred ripening agents are sulfur containing ripening agents, such as thioethers and thiocyanates. Typical thiocyanate ripening agents are disclosed by Nietz et al U.S. Pat. No. 2,222,264, Lowe et al U.S. Pat. No. 2,448,534 and Illingsworth U.S. Pat. No. 3,320,069, the disclosures of which are here incorporated by reference. Typical thioether ripening agents are disclosed by McBride U.S. Pat. No. 3,271,157, Jones U.S. Pat. No. 3,574,628 and Rosencrantz et al U.S. Pat. No. 3,737,313, the disclosures of which are here incorporated by reference. More recently crown thioethers have been suggested for use as ripening agents. Ripening agents containing a primary or secondary amino moiety, such as imidazole, glycine or a substituted derivative, are also effective. Sodium sulfite has also been demonstrated to be effective in increasing the percentage of total grain projected accounted by the {100} tabular grains.

The subsequent grain growth process of this invention departs from the teachings of House et al, Brust et al and Chang et al, which teach the controlled addition of silver and halide salts to grow the grains while limiting introduction rates so as to avoid renucleation. As is well understood in the art the small grains present immediately following Step (1) present a limited surface area. To prevent subsequently added silver and halide ions from forming additional silver halide grains the rates of silver and halide introduction are limited to less than the rate at which silver halide can be deposited on the surfaces of the grains formed in Step (1).

In the practice of this invention the same silver and halide ions taught for incorporation during Step (2) of Chang et al are introduced, except that the rate of introduction is such that a separate grain population is formed. Alternatively, this grain population can be separately formed and added as a preformed emulsion to the reaction vessel. This second grain population is then ripened out onto the grains containing the crystal lattice structures (generally believed to be screw dislocations) required for their growth into {100} tabular grains. Most, if not all, of any grains formed in Step (1) that failed to receive the required crystal lattice structure are also ripened out. Once a grain has received the crystal lattice modification required for growth into a tabular grain, its rate of growth is much higher than the remaining grains, and it is unlikely to be ripened out so long as regular grains (those lacking internal crystal lattice defects, such as screw dislocations) remain present.

Although not required, certain preferred features can be selected for the grain growth step that drive the ripening dissolution of grains other than those capable of growing into {100} tabular grains. First, the smaller the mean ECD's of the second grain population, the greater the Ostwald ripening forces favoring their dissolution by ripening. Thus, the second grain population in one preferred form has a mean ECD smaller than that of the grain population formed in Step (1). Another driving force promoting ripening dissolution is formation of the second grain population of an overall halide content having a higher solubility than the overall silver halide content of the grains population formed in Step (1). For example, it is specifically preferred that the second grain population be a high (>50 mole %) chloride grain population. It is not necessary to incorporate any iodide or bromide in the second grain population. If iodide and/or bromide is incorporated, it is preferred that the concentrations remain equal to or less than those of the grains formed in Step (1). These are, of course, only preferences, since grains having crystal lattice structures favorable for growth into tabular grains will be the net recipient of silver halide from regular grains under all but the most adverse ripening conditions.

It is specifically contemplated that, once a high chloride {100} tabular grain population has been formed, it can be modified by the introduction of a high iodide band as taught by Brust et al, cited above and here incorporated by reference. Brust et al requires only very small amounts of silver to form a higher iodide band and hence unwanted thickening of the tabular grains by band formation can be held to a minimal level. Silver salt epitaxy deposition onto the high chloride {100} tabular grains is also contemplated, as illustrated by Maskasky U.S. Pat. No. 5,275,930, the disclosure of which is here incorporated by reference.

In the course of grain precipitation one or more dopants (grain occlusions other than silver and halide) can be introduced to modify grain properties. For example, any of the various conventional dopants disclosed in *Research Disclosure*, Item 36544, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference. The dopants can be added during Step (1) or Step (2), e.g., in the formation of the second grain population, or even in a final, post-ripening precipitation step. Dopants are capable of migrating from the second grain population to the high chloride {100} tabular grains during growth.

It is specifically contemplated to include in the high chloride {100} tabular grains shallow electron trapping (SET) dopants. A comprehensive description of SET dopants is provided by *Research Disclosure*, Vol. 367, November 1994, Item 36736.

In a specific preferred form it is contemplated to employ as a SET dopant a hexacoordination complex satisfying the formula:

$$[ML_6]^n \quad (I)$$

where

M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$ or $Pt^{+4}$;

$L_6$ represents six coordination complex ligands which can be independently selected, provided that least four of the ligands are anionic ligands and at least one (preferably at least 3 and optimally at least 4) of the ligands is more electronegative than any halide ligand; and n is −1, −2, −3 or −4.

The following are specific illustrations of dopants capable of providing shallow electron traps:

| | |
|---|---|
| SET-1 | $[Fe(CN)_6]^{-4}$ |
| SET-2 | $[Ru(CN)_6]^{-4}$ |
| SET-3 | $[Os(CN)_6]^{-4}$ |
| SET-4 | $[Rh(CN)_6]^{-3}$ |
| SET-5 | $[Ir(CN)_6]^{-3}$ |
| SET-6 | $[Fe(pyrazine)\ (CN)_5]^{-4}$ |
| SET-7 | $[RuCl(CN)_5]^{-4}$ |

-continued

| | |
|---|---|
| SET-8 | $[OsBr(CN)_5]^{-4}$ |
| SET-9 | $[RhF(CN)_5]^{-3}$ |
| SET-10 | $[IrBr(CN)_5]^{-3}$ |
| SET-11 | $[FeCO(CN)_5]^{-3}$ |
| SET-12 | $[RuF_2(CN)_4]^{-4}$ |
| SET-13 | $[OsCl_2(CN)_4]^{-4}$ |
| SET-14 | $[RhI_2(CN)_4]^{-3}$ |
| SET-15 | $[IrBr_2(CN)_4]^{-3}$ |
| SET-16 | $[Ru(CN)_5(OCN)]^{-4}$ |
| SET-17 | $[Ru(CN)_5(N_3)]^{-4}$ |
| SET-18 | $[Os(CN)_5(SCN)]^{-4}$ |
| SET-19 | $[Rh(CN)_5(SeCN)]^{-3}$ |
| SET-20 | $[Ir(CN)_5(HOH)]^{-2}$ |
| SET-21 | $[Fe(CN)_3Cl_3]^{-3}$ |
| SET-22 | $[Ru(CO)_2(CN)_4]^{-1}$ |
| SET-23 | $[Os(CN)Cl_5]^{-4}$ |
| SET-24 | $[Co(CN)_6]^{-3}$ |
| SET-25 | $[Ir(CN)_4(oxalate)]^{-3}$ |
| SET-26 | $[In(NCS)_6]^{-3}$ |
| SET-27 | $[Ga(NCS)_6]^{-3}$ |
| SET-28 | $[Pt(CN)_4(H_2O)_2]^{-1}$ |

Instead of employing hexacoordination complexes containing $Ir^{+3}$, it is preferred to employ $Ir^{+4}$ coordination complexes. These can, for example, be identical to any one of the iridium complexes listed above, except that the net valence is −2 instead of −3. Analysis has revealed that $Ir^{+4}$ complexes introduced during grain precipitation are actually incorporated as $Ir^{+3}$ complexes. Analyses of iridium doped grains have never revealed $Ir^{+4}$ as an incorporated ion. The advantage of employing $Ir^{+4}$ complexes is that they are more stable under the holding conditions encountered prior to emulsion precipitation. This is discussed by Leubner et al U.S. Pat. No. 4,902,611, here incorporated by reference.

The SET dopants are effective at any location within the grains, including in silver salt epitaxy, if present. Generally better results are obtained when the SET dopant is incorporated in the exterior 50 percent of the grain, based on silver. To insure that the dopant is in fact incorporated in the grain structure and not merely associated with the surface of the grain, it is preferred to introduce the SET dopant prior to forming an elevated iodide band of the type disclosed by Brust et al. Thus, an optimum grain region for SET incorporation is that formed by silver ranging from 50 to 85 percent of total silver forming the grains. That is, SET introduction is optimally commenced after 50 percent of total silver has been introduced and optimally completed by the time 85 percent of total silver has precipitated. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

Many of the SET dopants are also effective to reduce reciprocity failure, particularly the iridium containing set dopants. Iridium dopants that are ineffective to provide shallow electron traps—e.g., either bare iridium ions or iridium coordination complexes that fail to satisfy the more electropositive than halide ligand criterion of formula I above can be incorporated into the grains of the high chloride {100} tabular grain emulsions to reduce reciprocity failure. These iridium dopants are effective to reduce both high intensity reciprocity failure (HIRF) and low intensity reciprocity failure (LIRF). The term HIRF is applied to departures from the reciprocity law for varied exposure times ranging up to 1 second. The term LIRF is applied to departures from the reciprocity law for varied exposure times ranging from 1 second to 10 seconds, 100 seconds or longer time intervals.

The reciprocity failure reducing Ir dopant can be introduced into the silver iodochloride grain structure as a bare metal ion or as a non-SET coordination complex, typically a hexahalocoordination complex. In either event, the iridium ion displaces a silver ion in the crystal lattice structure. When the metal ion is introduced as a hexacoordination complex, the ligands need not be limited to halide ligands. The ligands are selected as previously described in connection with formula I, except that the incorporation of ligands more electropositive than halide is restricted so that the coordination complex is not capable of acting as a shallow electron trapping site.

To be effective for reciprocity improvement the Ir must be incorporated within the grain structure. To insure total incorporation it is preferred that Ir dopant introduction be complete by the time 99 percent of the total silver has been precipitated. For reciprocity improvement the Ir dopant can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations. The reason for this is that these dopants form deep electron traps and are capable of decreasing grain sensitivity if employed in relatively high concentrations. These non-SET Ir dopants are preferably incorporated in concentrations of at least $1\times10^{-9}$ mole per silver up to $1\times10^{-6}$ mole per silver mole. However, higher levels of incorporation can be tolerated, up about $1\times10^{-4}$ mole per silver, when reductions from the highest attainable levels of sensitivity can be tolerated. Specific illustrations of useful Ir dopants contemplated for reciprocity failure reduction are provided by B. H. Carroll, "Iridium Sensitization: A Literature Review", *Photographic Science and Engineering, Vol.* 24, No. 6 November/December 1980, pp. 265–267; Iwaosa et al U.S. Pat. No. 3,901,711; Grzeskowiak et al U.S. Pat. No. 4,828,962; Kim U.S. Pat. No. 4,997,751; Maekawa et al U.S. Pat. No. 5,134,060; Kawai et al U.S. Pat. No. 5,164,292; and Asami U.S. Pat. Nos. 5,166,044 and 5,204,234.

The contrast of the radiographic elements of the invention containing high chloride {100} tabular grain emulsions can be further increased by doping the grains with a hexacoordination complex containing a nitrosyl or thionitrosyl ligand. Preferred coordination complexes of this type are represented by the formula:

$$[TE_4(NZ)E']^r \quad \text{(II)}$$

where

T is a transition metal;

E is a bridging ligand;

E' is E or NZ;

r is zero, −1, −2 or −3; and

Z is oxygen or sulfur.

The E ligands can take any of the forms found in the SET dopants and non-SET Ir dopants discussed above. A listing of suitable coordination complexes satisfying formula IV is found in McDugle et al U.S. Pat. No. 4,933,272, the disclosure of which is here incorporated by reference.

The contrast increasing dopants (hereinafter also referred to as NZ dopants) can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{+11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

Except for the intentional creation of a second grain population, the conditions and techniques for growth of high chloride {100} tabular grains can correspond to those employed for grain growth without nucleation taught by House et al, Brust et al and Chang et al, cited above and here incorporated by reference.

Once any emulsion according to the invention has been prepared, it can be further prepared for photographic use by any convenient conventional technique.

The first step is usually to wash the emulsion. Chemical sensitization and, in most instances, spectral sensitization are undertaken. Antifoggant and stabilizer addition is usually undertaken. The emulsions are also combined with additional levels of photographic vehicle before coating. Hardeners are incorporated in one or more photographic vehicle containing layers. Varied, conventional preparations of the emulsions of the invention for photographic use are illustrated by *Research Disclosure*, Item 36544, cited above. Although *Research Disclosure*, Item 36544, has been relied upon to illustrate conventional photographic features, it is recognized that numerous other publications also disclose conventional features, including the following:

James *The Theory of the Photographic Process*, 4th Ed., Macmillan, New York 1977;

*The Kirk-Othmer Encyclopedia of Chemical Technology*, John Wiley and Sons, New York 1993;

Neblette's *Imaging Processes and Materials*, Van Nostrand Reinhold, New York 1988; and Keller, *Science and Technology of Photography*, VCH, New York 1993.

EXAMPLES

The invention can be better appreciated by reference to the following specific embodiments. The suffix E is employed to designate embodiments satisfying invention requirements while the suffix C is employed to designate embodiments not satisfying invention requirements, but included for purposes of comparison.

Example 1C

This comparative example demonstrates the preparation of a high chloride {100} tabular grain emulsion having a mean grain ECD of 2.4 μm and a mean grain thickness of 0.18 μm, following a preparation procedure of the type described by Chang et al, cited above, with a higher iodide band formed toward the end of grain growth as taught by Brust et al, cited above.

An 18 L reactor charged with 4369 g of distilled water containing 3 g of NaCl, 195 g of oxidized gelatin, and 0.86 mL of a polyethylene glycol dialkyl ester antifoamant, was adjusted to pH 5.7 at 35° C. The contents of the reactor were stirred vigorously throughout the precipitation process. To the initially introduced solution were added simultaneously 1M $AgNO_3$ and 4M NaCl solutions, at a rate of 78 mL/min and 20.1 mL/min, respectively, for 1.6 minutes. The pCl was maintained at 1.97 during nucleation.

A solution containing 9267 g distilled water, 2.25 g NaCl, and 0.57 g KI, was then added. The solution was allowed to stand for 5 minutes. After the hold, the mixture temperature was ramped from 35° C. to 36.5° C. in 2 minutes, and, during the same time interval, 4M $AgNO_3$ (containing 0.08 mg mercuric chloride per mole of silver nitrate) and 4M NaCl solutions were added at 15 mL/min each, with pCl ramped from 2.19 to 2.35. The temperature was further ramped from 36.5° C. to 50° C. in 18 minutes, during which period the $AgNO_3$ and NaCl solutions were added at 15 mL/min, with pCl shifting from 2.35 to 2.21. The temperature was further ramped from 50°C. to 70° C. in 20 minutes, during which period the $AgNO_3$ and NaCl solutions were added at linearly accelerated rates of from 15 mL/min to 22.5 mL/min, with pCl linearly decreased from 2.21 to 1.72. After the ramp, the medium was allowed to stand at 70° C. for 15 minutes. After the hold, addition of the $AgNO_3$ and NaCl solutions was resumed at linearly accelerated rates from 15 to 40.3 mL/min in 42.4 minutes. The pCl of the emulsion was held at 1.72 during this growth period. Then the reactor was allowed to stand at 70° C. with vigorous stirring for another 30 minutes.

After the hold, a 100 mL solution containing 6.70 g of KI was added, and the emulsion was allowed to stand for 10 minutes. Final grain growth was completed by adding 4M $AgNO_3$ (containing 0.08 mg mercuric chloride per mole of silver nitrate) and 4M NaCl solutions at linearly accelerated rates of from 40.3 to 42.2 mL/min for 3.4 minutes, with pCl maintained at 1.72.

The resultant emulsion was a high chloride {100} tabular grain emulsion containing 0.55 mole percent iodide, based on silver, the remainder of the halide being chloride. The emulsion grains had a mean ECD of 2.4 μm, a mean grain thickness of 0.18 μm, with the {100} tabular grains accounting for 90% of total grain projected area.

This comparative example demonstrates that following the teachings of the art failed to produce a very thin (≦0.1 μm) high chloride {100} tabular grain emulsion with a mean grain ECD in the range of from 2.0 to 5.0 μm.

Example 2C

This comparative example further demonstrates that a very thin high chloride {100} tabular grain emulsion could not be prepared by the preparation procedure of Chang et al, cited above, even when the mean ECD of the tabular grains was limited to 1.7 μm. Like Example 1C, a higher iodide was introduced toward the end of grain growth.

An 18 L reactor charged with 4369 g of distilled water containing 3 g of NaCl, 195 g of oxidized gelatin, and 0.86 ml of a polyethylene glycol dialkyl ester antifoamant was adjusted to pH 5.7 at 35° C. The contents of the reactor were stirred vigorously throughout the precipitation process. To the initially introduced solution were added simultaneously 1M $AgNO_3$ and 4M NaCl solutions, at a rate of 78 mL/min and 20.1 mL/min, respectively, for 1.6 minutes. The pCl was maintained at 1.97 during nucleation.

A solution containing 9267 g distilled water, 2.25 g NaCl, and 0.65 g KI was then added. The solution was allowed to stand for 5 minutes. After the hold, the mixture temperature was ramped from 35° C. to 36.5° C. in 2 minutes, and during the same time 4M $AgNO_3$ containing 0.08 mg mercuric chloride per mole of silver nitrate and 4M NaCl solutions were added at 15 mL/min each, with pCl ramped from 2.19 to 2.35. The temperature was further ramped from 36.5° C. to 50° C. in 18 minutes, during which period the $AgNO_3$ and NaCl solutions were added at 15 mL/min, with pCl shifting from 2.35 to 2.21. The temperature was further ramped from 50° C. to 70° C. in 20 minutes, during which period the $AgNO_3$ and NaCl solutions were added at linearly accelerated rates of from 15 mL/min to 22.5 mL/min, with pCl linearly decreased from 2.21 to 1.72. After the ramp, the medium was allowed to stand at 70° C. for 15 minutes. After the hold, addition of the $AgNO_3$ and NaCl solutions was resumed at linearly accelerated rates from 15 to 40.3 mL/min in 42.4 minutes. The pCl of the emulsion was held at 1.72 during this growth period. Then the reactor was allowed to stand at 70° C. with vigorous stirring for another 30 minutes.

After the hold, a 100 mL solution containing 6.70 g of KI was added, and the emulsion was allowed to stand for 10 minutes. Final grain growth was completed by adding 4M AgNO3 containing 0.08 mg mercuric chloride per mole of silver nitrate and 4M NaCl solutions at linearly accelerated rates of from 40.3 to 42.2 mL/min for 3.4 minutes, with pCl maintained at 1.72.

The resultant comparative emulsion was a high chloride {100} tabular grain with 0.55 mole percent iodide based on silver, the remainder of the halide being chloride. The emulsion had a mean grain ECD of only 1.7 micrometers, but the mean grain thickness was 0.15 μm, well above the ≦0.1 μm thickness criterion for a very thin tabular grain emulsion. The high chloride {100} tabular grains accounted for 90% of total grain projected area.

Example 3E

This example demonstrates the effectiveness of creating a second grain population after initial grain nucleation to produce a very thin high chloride {100} tabular grain emulsion with a mean ECD in the range of from 2.0 to 5.0 μm. The grain also contains a higher iodide band formed according to the teachings of Brust et al, cited above.

An 18 L reactor charged with 4369 g of distilled water containing 3 g of NaCl, 195 g of oxidized gelatin, and 0.86 mL of a polyethylene glycol dialkyl ester antifoamant was adjusted to pH 5.7 at 35° C. The contents of the reactor were stirred vigorously throughout the precipitation process. To the initially introduced solution were added simultaneously 1M $AgNO_3$ and 4M NaCl solutions, at a rate of 78 mL/min and 20.1 mL/min, respectively, for 1.6 minutes. The pCl was maintained at 1.97 during nucleation.

A solution containing 9267 g distilled water, 2.25 g NaCl, and 0.57 g KI was then added. The solution was allowed to stand for 5 minutes. After the hold, 4M $AgNO_3$ (containing 0.08 mg mercuric chloride per mole of silver nitrate) and 4M NaCl were delivered to the reaction vessel at 200 mL/min for 9.2 minutes, and the pCl was maintained at 2.19. This high rate of introduction of reactants resulted in renucleation (i.e., the creation of a new population of grains). During the next 15 minutes, the temperature was raised linearly from 35° C. to 70° C. During the following 5 minutes the pCl was adjusted from 1.88 to 1.72 with 4M NaCl solution added at 14.3 mL/min. After the pCl adjustment, the solution was allowed to stand at 70° C. for 72 minutes.

After the hold, a 100 mL solution containing 6.70 g of KI was added, and the emulsion was allowed to stand for 10 minutes. Final grain growth was completed by adding 4M $AgNO_3$ (containing 0.08 mg mercuric chloride per mole of silver nitrate) and 4M NaCl solutions at 20.0 mL/min for 7.0 minutes, with pCl maintained at 1.72.

The resultant emulsion was a high chloride {100} tabular grain emulsion containing 0.55 mole percent iodide, based on silver, the remainder of the halide being chloride. The emulsion grains had a mean ECD of 2.1 μm, a mean grain thickness of 0.10 μm, with high chloride {100} tabular grains accounting for 90% of total grain projected area.

This example demonstrates that following the procedure of the invention produced a very thin (≦0.1 μm) high chloride {100} tabular grain emulsion with a mean grain ECD in the range of from 2.0 to 5.0 μm.

Example 4E

This example demonstrates that very thin high chloride {100} tabular grain emulsions satisfying invention requirements can be prepared with much larger mean ECD's than demonstrated in Example 3E without thickening the tabular grains.

A 12 L reactor charged with 3.0 L of distilled water containing 2 g of NaCl, 1 mL of ethylene oxide/propylene oxide block copolymer antifoamant, and 153 g of regular gelatin was adjusted to pH 5.7 at 35° C. The reactor was stirred vigorously throughout the precipitation process. To this solution were added simultaneously 0.5M $AgNO_3$ and 0.5M NaCl solutions each at a rate of 25 mL/min for 0.8 minute. The pCl was maintained at 2.39 during nucleation.

A solution containing 5.8 L of distilled ater and 40 g of 0.012M KI solution was then added. The solution was allowed to stand for 5 minutes. After the hold, 4M solutions of silver nitrate and sodium chloride were added simultaneously at 50 mL/min for 14 minutes while maintaining pCl at 2.3. The solution temperature was then ramped to 80° C. in 21 minutes and then the reactor contents were held at this temperature for another 135 minutes with pCl maintained at 3.1.

The resultant emulsion was a high chloride {100} tabular grain emulsion having a mean grain ECD of 3.5 μm and a mean grain thickness of 0.10 μm, with high chloride {100} tabular grains accounting for 80% of total grain projected area.

Example 5E

This example demonstrates the capability of the process of this invention to produce a high chloride {100} tabular grain emulsion with a mean grain ECD in the range of from 2.0 to 5.0 μm with a mean grain thickness significantly less than 0.1 μm.

A 12 L reactor charged with 3.0 L of distilled water containing 2 g of NaCl, 1 mL of ethylene oxide/propylene oxide block copolymer antifoamant, and 153 g of regular gelatin was adjusted to pH 5.7 at 35 C. The reactor was stirred vigorously throughout the precipitation process. To this solution were added simultaneously 0.5M $AgNO_3$ and 0.5M NaCl solutions each at a rate of 25 mL/min for 0.8 minutes. pCl was maintained at 2.39 during nucleation.

A solution containing 5.8 L of distilled water, 40 g of 0.012M KI solution, and 1.5 g of NaCl was then added. The solution was allowed to stand for 5 minutes. After the hold, 4M solutions of silver nitrate and sodium chloride were added simultaneously at 100 mL/min for 7 minutes while maintaining pCl at 2.23. The pCl of the solution was then adjusted to 3.49. The solution temperature was ramped to 80° C. in 21 minutes and then held at this temperature for another 90 minutes.

The resultant high chloride {100} tabular grain emulsion had a mean grain ECD of 2.2 μm, a mean grain thickness of 0.08 μm, with {100} tabular grains accounting for 70% of total grain projected area.

The invention has been described in detail with particular reference to preferred embodiments thereof, but it will be understood that variations and modifications can be effected within the spirit and scope of the invention.

What is claimed is:

1. A radiation-sensitive emulsion comprised of a dispersing medium and silver halide grains wherein at least 70 percent of total grain projected area is accounted for by tabular grains (a) having {100} major faces, (b) containing greater than 50 mole percent chloride, based on silver, (c) having a mean equivalent circular diameter in the range of from 2.0 to 5.0 μm, and (d) exhibiting a mean thickness of 0.1 μm or less.

2. A radiation-sensitive emulsion according to claim 1 wherein said mean equivalent circular diameter is in the range of from 2.5 to 4.0 μm.

3. A radiation-sensitive emulsion according to claim 1 wherein said tabular grains account for at least 90 percent of total grain projected area.

4. A radiation-sensitive emulsion according to claim 1 wherein said tabular grains contain greater than 90 mole percent chloride, based on silver.

5. A radiation-sensitive emulsion according to claim 1 wherein said tabular grains contain from 0.001 to less than 10 mole percent iodide, based on silver.

6. A radiation-sensitive emulsion according to claim 5 wherein said tabular grains contain at least 0.07 mole percent iodide, based on silver.

7. A radiation-sensitive emulsion according to claim 5 wherein said tabular grains are silver iodochloride tabular grains.

* * * * *